US006532614B2

(12) United States Patent
Bloom

(10) Patent No.: US 6,532,614 B2
(45) Date of Patent: Mar. 18, 2003

(54) PAINT SCRAPER WITH NAILSET

(75) Inventor: Bertil Bloom, Bollnäs (SE)

(73) Assignee: Kapman AB, Sandviken (SE)

( * ) Notice: Subject to any disclaimer, the term of this patent is extended or adjusted under 35 U.S.C. 154(b) by 0 days.

(21) Appl. No.: 09/892,579

(22) Filed: Jun. 28, 2001

(65) Prior Publication Data

US 2002/0026672 A1 Mar. 7, 2002

(30) Foreign Application Priority Data

Apr. 7, 2000 (SE) ..... 0002549

(51) Int. Cl.[7] ..... B44C 7/00
(52) U.S. Cl. ..... 7/105; 87/44
(58) Field of Search ..... 7/105, 144; 87/44, 87/45, 46, 23

(56) References Cited

U.S. PATENT DOCUMENTS

| | | | | | |
|---|---|---|---|---|---|
| 2,783,799 | A | * | 3/1957 | Hart | 81/44 |
| 2,979,092 | A | * | 4/1961 | Bradford | 81/44 |
| 3,363,316 | A | * | 1/1968 | Skarsten | 7/105 |
| 5,097,554 | A | * | 3/1992 | McLaughlin | 7/105 |
| 5,546,625 | A | * | 8/1996 | Mealey, Sr. | 7/105 |
| 5,842,389 | A | * | 12/1998 | Halstead | 81/44 |

* cited by examiner

*Primary Examiner*—James G. Smith
(74) *Attorney, Agent, or Firm*—Burns, Doane, Swecker & Mathis, LLP

(57) ABSTRACT

A paint scraper includes a main body formed by a handle and a blade-supporting shank extending forwardly thereof. A nailset element is attached to the main body and is movable downwardly in response to being struck, so that a nail-impacting end of the nailset element can sink a protruding nail that is encountered while scraping paint from a wooden surface.

17 Claims, 2 Drawing Sheets

PAINT SCRAPER WITH NAILSET

This application claims priority under 35 U.S.C. §§ 119 and/or 365 to Patent Application Ser. No. 0002549-4 filed in Sweden on Apr. 4, 2000, the entire content of which is hereby incorporated by reference.

BACKGROUND OF THE INVENTION

When wooden surfaces are scraped clean as a preparation for painting, it is a common occurrence that heads of nails are protruding above the desired wood surface. This is especially common if the original wood surface often has been worn, eroded or shrunk. To achieve a smooth scraped surface, one must be prepared to sink an encountered nail head to a level at or slightly below the final wood surface. This must not be done with a hammer blow directly at the nail head, since in that case the adjacent wood surface would be deformed and compressed, but liable to rise later when exposed to moisture, thus making the final painted surface uneven.

If the nail heads are not sunk deeply enough, the scraped surface will be uneven, and the scraper or its edge may be damaged.

Sinking of protruding nail heads must then be done with narrow blunt nailsets, which are traditionally held with one hand while striking them with a hammer held in the other hand. It is difficult to do this with enough precision, especially if it has to be done while standing on a ladder or a scaffold close to a wall, since there is a risk of falling when both hands are holding tools, none of which can be relied on as a support against the wall.

In many cases the force needed is small, and the nail head protrudes because the wood in which the nail sits was or gradually has become soft.

The invention concerns a paint scraper combined with a nailset, which compared to the traditional method offers a higher precision, and in most cases makes it unnecessary to bring a hammer. The risk of failing is reduced, since the edge and handle of the paint scraper can be used to support against the wall at the same time as the nailset is stably located above the nail head.

SUMMARY OF THE INVENTION

The invention pertains to a paint scraper that includes a main body having a manually grippable handle portion, and a shank portion extending forwardly from the handle portion. The shank portion includes a blade-supporting portion at a front end thereof for supporting a paint scraping blade. The paint scraper further includes a nailset portion mounted to the main body and including a nailset element having a nail-impacting end and a striker end adopted to be struck.

BRIEF DESCRIPTION OF THE DRAWINGS

The objects and advantages of the invention will become apparent from the following detailed description of a preferred embodiment thereof in connection with the accompanying drawing in which like numerals designate like elements, and in which.

DETAILED DESCRIPTION OF PREFERRED EMBODIMENTS OF THE INVENTION

Figure 1:
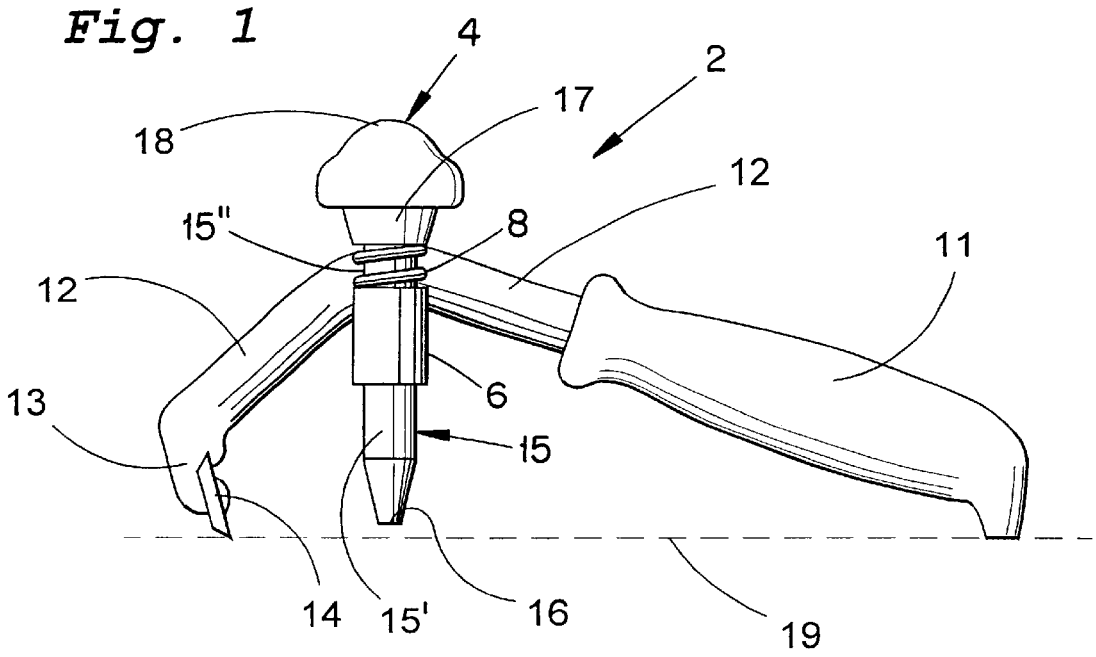
FIG. 1 showing a lateral view of a first embodiment of the paint scraper.
Figure 4:
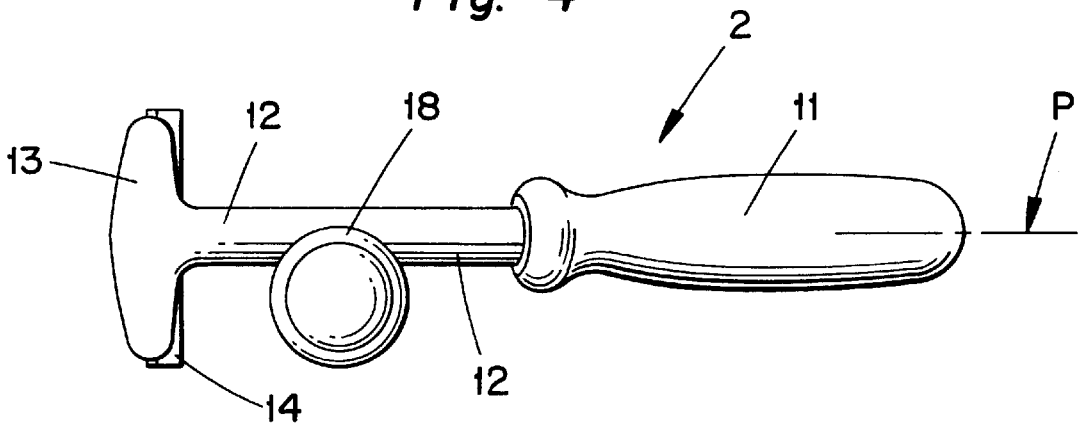
FIG. 4 showing a top view of FIG. 1.

The paint scraper (2) shown in FIGS. 1 and 4 comprises a main body including a handle (11), a shank (12) and a blade supporting part (13), where preferably the held blade (14) is replaceable. On the shank is attached a nailset portion (4) that is laterally offset with respect to a vertical plane P in which the main body (11, 12) lies. The nailset portion (4) includes a sleeve (6) and a nailset element (15) slidably mounted in the sleeve. The nailset element (15) includes a bottom part (15') extending downwardly past the sleeve (6) and the shank (12), and an upper part (15") extending upwardly past the sleeve (6) and the shank (12).

The bottom part (15') ends with a flat bottom surface (16), (i.e., a nail-impacting end), preferably slightly smaller than the heads of relevant nail sizes. The element (15) is mounted to the shank (12) or to a part united with the shank in such a way that when it moves down, it does so against the force of a spring (8). The element (15) has a limited upward mobility, and when in a resting position, the flat bottom surface will be spaced above a plane or line (19) in which both the rear end of the handle and the edge of the blade (14) lie. This means that if the paint scraper is held with one hand against a flat area to be scraped, it is simple to locate it with the flat bottom surface immediately above a nail head, and at the same time it can serve as a support, e.g., against a wall. Also, there is no risk that the nailset would scratch or indent the scraped surface, not even while scraping.

It will be appreciated that types of spring arrangements could be provided other than a coil compression spring.

The upper part (15") includes an enlarged head (17) against which the spring (8) acts. The head (17) is provided with a larger smooth top (18) (i.e., a striker end), preferably of convex shape. The top is so arranged that a downward motion of the top (18) forces the bottom surface (16) of the bottom part to move downward. Such motions can be forced by hitting the top (18) with the hand or with a hammer, so the top must be provided with a smooth surface which is not damaged by the hammer blow or which does not hurt the hand. Preferably the head (17) can be knob-shaped or bell-shaped to serve as a second handle while scraping with two hands.

Figure 3:
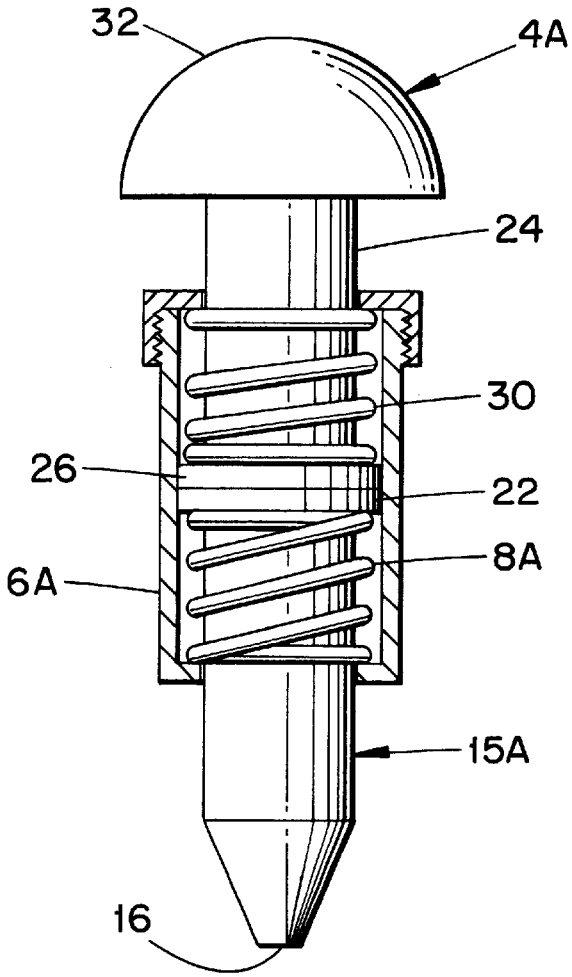
FIG. 3 showing a sectional view taken through a modified form of nailset portion.

In a second embodiment of the nailset portion, shown in FIG. 3, a third method can be used to provoke a downward motion of the bottom surface (16), where the nailset portion (4A) includes a nailset element (15A) having a striker end in the form of a flange (22) that terminates within a sleeve (6A). Disposed above the nailset element (1 5A) is a striker element (24) having a top (32) and a flange (26) adapted to abut the flange (22) of the nailset element (15A). The nailset element (15A) is biased upwardly by a lower spring (8A), and the striker element (24) is biased downwardly by an upper spring (30), In such a case, one can lift the striker element (24) with one hand and then release it so that the force of the upper spring (30) makes it hit and impact upon the nailset element (4) to urge the latter downwardly against a nail head. In this embodiment, striking the striker element (24) with the hand or a hammer is also possible, wherein the parts (15A) and (24) could be considered as together forming a nailset element, and the top (32) forming a striker end.

Figure 2:
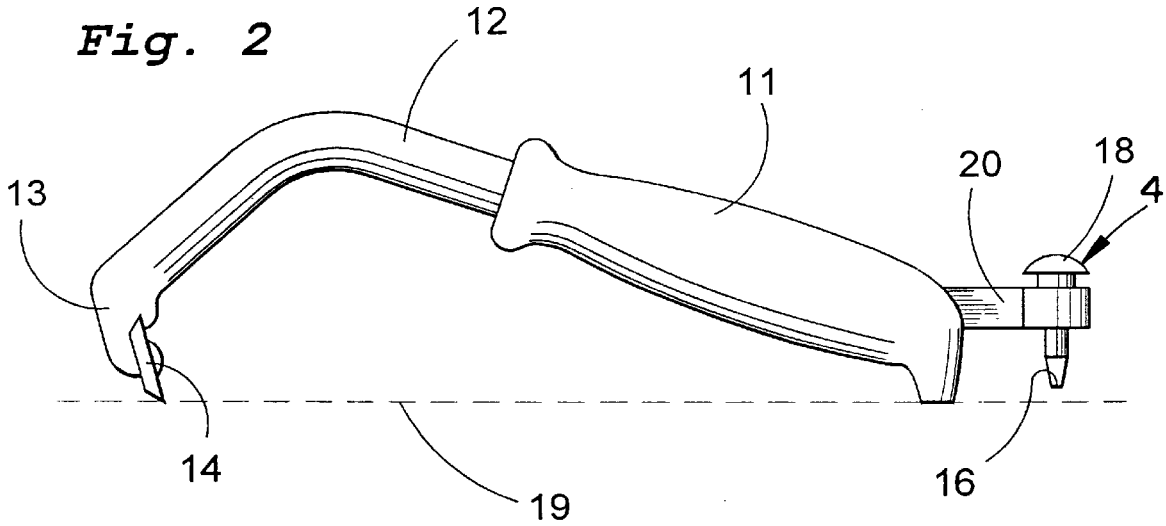
FIG. 2 showing a lateral view of another embodiment of a paint scraper.

In a third embodiment shown in FIG. 2, the shank (12) has an elongated portion (20) extending through and beyond the handle (11), and the nailset portion (4) is attached to that elongated portion (20) so that it is located closely behind the handle while scraping. This embodiment, wherein the nailset element lies in the same plane of the main body, i.e., a plane corresponding to the plane P of FIG. 4, allows a better visibility for the bottom surface (16) in relation to the nail head, and better accessibility near walls and corners, but does not allow convenient use of the upper part as a second handle while scraping with two hands as is possible in connection with the earlier-described embodiments.

The nailset portion employed in the FIG. 3 embodiment could alternatively be of any suitable construction, e.g., similar to the nailset portion (4A) of FIG. 2.

It will be appreciated that although the use of a spring (8), or multiple springs (30, 8A) is preferred, the spring (8) could be eliminated in the FIG. 1 embodiment; and the upper spring (30) could be eliminated in the FIG. 3 embodiment if the nail setting operation were to be always performed by striking downwardly against the upper part.

Another alternative to the FIG. 1 embodiment is to eliminate the spring (8), and form the sleeve (6) and the nailset portion (4) as an integral unit that is attached to the shank (12) by a spring, such as a leaf spring.

The concept of the invention also encompasses other known or simple modifications of the paint scraper or the nailset parts, such as the shape of the blade or its attachment, or the configuration of the springs in the nailset.

What is claimed is:

1. A paint scraper comprising:

a main body including:

a manually grippable handle portion, and a shank portion extending forwardly from the handle portion and including a blade-supporting portion at a front end of the shank portion;

a paint scraping blade mounted to the blade-supporting portion; and a nailset portion mounted to the main body and including a nailset element having a nail-impacting end and a striker end adapted to be struck.

2. The paint scraper according to claim 1 wherein the nailset element is movable relative to the main body in response to the striker end being struck.

3. The pain scraper according to claim 2 wherein the nailset portion further includes a spring yieldably opposing the movement of the nailset element.

4. The paint scraper according to claim 3 wherein the nailset portion further comprises a sleeve fixed to the main body, the nailset element being slidably mounted in the sleeve.

5. The paint scraper according to claim 2 wherein the blade includes a cutting edge lying in a common plane with a rear end of the handle portion, a spring provided for biasing the nail-impacting end upwardly above that plane.

6. The paint scraper according to claim 2 wherein the nailset portion further comprises a sleeve fixed to the main body, the nailset element being slidably mounted in the sleeve.

7. The pain scraper according to claim 2 wherein the nailset portion further comprises a manually displaceable striker element movable relative to the nailset element and disposed over the striker end thereof, and a spring for yield ably biasing the striker element toward the striker end of the nailset element.

8. The paint scraper according to claim 1 wherein the nailset portion is mounted to the main body intermediate the front end of the shank portion and a rear end of the handle portion.

9. The paint scraper according to claim 8 wherein the nailset portion is attached to the shank portion.

10. The paint scraper according to claim 9 wherein the nailset portion is offset laterally from a plane in which the main body lies.

11. The paint scraper according to claim 1 wherein the nailset portion is mounted at one end of the main body and is situated within a plane in which the main body lies.

12. The paint scraper according to claim 11 wherein the nailset portion projects from a rear end of the main body.

13. The paint scraper according to claim 1 wherein the striker end is convexly rounded.

14. The paint scraper according to claim 1 wherein an upper part of the nailset element is knob-shaped to define an auxiliary manually grippable handle.

15. A paint scraper comprising:

a main body including:

a manually grippable handle portion, and a shank portion extending forwardly from the handle portion and including a blade-supporting portion at a front end of the shank portion for supporting a paint scraping blade; and a nailset portion mounted to the main body and including a nailset element having a nail-impacting end and a striker end adapted to be struck, wherein the nailset element is movable relative to the main body in response to the striker end being struck, the nailset portion further comprising a manually displaceable striker element movable relative to the nailset element and disposed over the striker end thereof, and a spring for yieldably biasing the striker element toward the striker end of the nailset element.

16. A paint scraper comprising:

a main body including:

a manually grippable handle portion, and a shank portion extending forwardly from the handle portion and including a blade-supporting portion at a front end of the shank portion for supporting a paint scraping blade; and a nailset portion mounted to the shank portion and including a nailset element having a nail-impacting end and a striker end adapted to be struck, wherein the nailset portion is offset laterally from a plane in which the main body lies.

17. A paint scraper comprising:

a main body including:

a manually grippable handle portion, and a shank portion extending forwardly from the handle portion and including a blade-supporting portion at a front end of the shank portion for supporting a paint scraping blade; and a nailset portion projecting from a rear end of the main body and including a nailset element having a nail-impacting end and a striker end adapted to be struck, wherein the nailset portion is situated within a plane in which the main body lies.

* * * * *